US005830616A

United States Patent [19]

Yaguchi et al.

[11] Patent Number: 5,830,616

[45] Date of Patent: Nov. 3, 1998

[54] MAGNETIC LATENT IMAGE DEVELOPING TONER

[75] Inventors: Shigenori Yaguchi, Hachioji; Atsushi Fujino, Tokyo, both of Japan

[73] Assignee: Iwatsu Electric Co., Inc., Tokyo, Japan

[21] Appl. No.: 893,203

[22] Filed: Jul. 15, 1997

Related U.S. Application Data

[63] Continuation-in-part of Ser. No. 674,609, Jun. 28, 1996, abandoned.

[30] Foreign Application Priority Data

Jul. 19, 1995 [JP] Japan ..... 7-182765
Dec. 8, 1995 [JP] Japan ..... 7-320246

[51] Int. Cl.[6] ..... G03G 9/14
[52] U.S. Cl. ..... 430/106.6; 430/110
[58] Field of Search ..... 430/110, 108, 430/109, 106.6

[56] References Cited

U.S. PATENT DOCUMENTS

| | | | |
|---|---|---|---|
| 4,221,856 | 9/1980 | Lu | 430/110 |
| 4,224,396 | 9/1980 | Pollet | 430/107 |
| 4,546,072 | 10/1985 | Matrick | 430/449 |
| 4,547,449 | 10/1985 | Alexandrovich et al. | 430/115 |
| 5,147,750 | 9/1992 | Nakanishi | 430/110 |
| 5,380,616 | 1/1995 | Aoki et al. | 430/110 |
| 5,401,809 | 3/1995 | Gitzel et al. | 525/337 |
| 5,516,616 | 5/1996 | Wilson et al. | 430/110 |
| 5,571,651 | 11/1996 | Inaba et al. | 430/110 |
| 5,616,444 | 4/1997 | Wilson et al. | 430/110 |

FOREIGN PATENT DOCUMENTS

| | | |
|---|---|---|
| 0476647 | 9/1991 | European Pat. Off. . |
| 4341726 | 12/1983 | Germany . |
| 27071 | 1/1990 | Japan . |
| 4151166 | 5/1992 | Japan . |
| 4198308 | 7/1992 | Japan . |

*Primary Examiner*—John Goodrow
*Attorney, Agent, or Firm*—Paul and Paul

[57] ABSTRACT

The present invention relates to a developing agent used for electrophotography, electrostatic recording, electrostatic printing, magnetic recording and the like, and particularly a developing agent with excellent image properties, fixing properties and storability, which is magnetic latent image developing toner.

The magnetic latent image developing toner of the invention contains a permanent antistatic agent which includes quaternary ammonium base-containing copolymer, and conductive powder, and the electrical resistance of the toner is in the range of $10^8$–$10^{14}$ Ω· cm. The magnetic latent image developing toner also contains external additives or a charge control agent, to keep the frictional electrification of the toner to between −5 and 5 μC/g.

3 Claims, No Drawings

MAGNETIC LATENT IMAGE DEVELOPING TONER

This application is a continuation-in-part of U.S. Ser. No. 08/674,607, filed Jun. 28, 1996, abandoned.

BACKGROUND OF THE INVENTION

1. Field of the Invention

The present invention relates to a developing agent used for electrophotography, electrostatic recording, electrostatic printing, magnetic recording and the like, and particularly to magnetic latent image developing toner used for magnetic recording.

2. Description of the Related Art

Magnetic recording is accomplished by a method wherein a magnetic head is used to write a magnetic latent image on a magnetic drum as the recording medium, and the latent image is developed with a one-component toner containing magnetic powder and then transferred and fixed; such a method is described in, for example, Japanese Unexamined Patent Publication No. 54-32328 (Japanese Examined Patent Publication No. 57-46795).

This method allows multiple copies to be obtained with a single magnetic latent image formation without fatigue of the photosensor as in electrophotography systems, and thus does not require replacement of the photosensor every 30,000 copies or so, thus providing the advantage of easier maintenance.

Furthermore, because printers with low ozone generation have been in demand in recent years in light of problems of environmental damage, the system of the invention uses a transfer process whereby a resin roller or the like is pressed against the back side of a recording medium such as paper, generating virtually no ozone, which is a method receiving particular attention in recent years.

The magnetic latent image developing toner used in this method contains a fixing resin for fixing onto the final recording paper, etc. and a magnetic powder with magnetic properties enabling development of magnetic latent images and transferability to the developing site.

Recent years have also seen demand for character sharpness required to obtain high image quality, as well as toners with adequate fixation at low temperature and sufficient image properties to meet the requirements for lower energy consumption and higher speed.

SUMMARY OF THE INVENTION

The transfer process by which a resin roller or the like is pressed against the back side of a recording medium such as paper has a drawback in that the image density varies considerably depending on the type and thickness of the recording medium, and this results in variation in the character sharpness.

Also, although increasing the transfer voltage reduces variations due to the type and thickness of the recording medium, discharge development occurring with the toner on the paper surface makes it impossible to increase the transfer voltage, resulting in the problem of reduced reflection density.

For this reason, the electrical resistance of the toner is preferably a relatively low value.

A method of lowering the electrical resistance of the toner has been proposed, for example, in Japanese Unexamined Patent Publication No. 2-7071, which method involves adding a conductive substance to the toner surface. A disadvantage of this method, however, is that a large amount of the conductive substance must be added to the toner surface, which impairs the fluidity of the toner, and that the character sharpness deteriorates when the conductive substance separates from the toner and transfers to the recording medium.

As indicated in Japanese Unexamined Patent Publication No. 4-151166, methods of lowering the electrical resistance by adding carbon black have resulted in lower fixing properties and inferior character sharpness because of the use of carbon black which has a large specific surface area and high oil absorbency. The present inventors, therefore, as described in filed Japanese Patent Application No. 7-182765, overcame this problem by adding a permanent antistatic agent containing a quaternary ammonium base-containing copolymer to lower the electrical resistance value of the resin itself, to thus obtain magnetic latent image developing toner with satisfactory image properties irrespective of paper type, and with sufficient fixing properties even during high-speed printing, as well as no head contamination.

Nevertheless, a drawback existed in that the image density is not sufficiently increased merely with permanent antistatic agents containing quaternary ammonium base-containing copolymers in the case of thicker paper or depending on the conditions of the use environment. An additional drawback with permanent antistatic agents containing quaternary ammonium base-containing copolymers is that they are prone to blocking during storage.

The present invention solves these problems by providing a magnetic latent image developing toner with satisfactory image properties irrespective of paper type, sufficient fixing properties even during high-speed printing, no head contamination, and satisfactory storage stability.

DESCRIPTION OF THE PREFERRED EMBODIMENTS

The above-mentioned problems are solved by the present invention which provides magnetic latent image developing toner with satisfactory image properties which do not vary depending on paper type, with sufficient fixing properties even during high-speed printing, and with good storage stability and no head contamination.

The present invention provides toner with an electrical resistance in the range of $10^8$–$10^{14}$ Ω·cm which contains 0.1 to 5 parts by weight of a permanent antistatic agent which includes a quaternary ammonium base-containing copolymer, and to which conductive powder is added at 0.1 to 3 parts by weight to 100 parts by weight of the toner.

Addition of a permanent antistatic agent including a quaternary ammonium base-containing copolymer to the toner allows reduction of the electrical resistance of the base toner itself.

Toner whose electrical resistance is controlled with a permanent antistatic agent including a quaternary ammonium base-containing copolymer has very excellent character sharpness and fixing properties compared to toner containing a conductive substance with about the same resistance value. It is thought that the reason for this is that when a conductive substance is added during the production of the toner, the conductive substance separates from the base toner during the toner manufacturing process, and transfers to the recording medium upon transfer, thus ruining the image. Internal addition of a conductive substance also impairs the fixing properties due to a relative lack of the resin component.

When a conductive substance is added to a degree for maintaining character sharpness, the electrical resistance of the toner itself is raised, leading to discharge development in the case of thick paper. The same result occurs even with mere addition of a conductive substance.

When conductive substances have been added in this manner, the reflection density has increased, but character sharpness has been lacking.

According to the invention, a permanent antistatic agent including a quaternary ammonium base-containing copolymer is added to the toner to lower the electrical resistance of the toner itself, and thus the object is achieved by addition of a conductive substance to the surface. Here, it is important that the conductive substance be added to a degree which maintains character sharpness, and such an amount is about the same as in toner with no permanent antistatic agent including a quaternary ammonium base-containing copolymer.

The amount of addition of the conductive substance will differ greatly depending on the particle size of the toner and the degree of conductivity, but it is preferably about 0.1 to 3 parts by weight to 100 parts by weight of toner.

The magnetic latent image developing toner according to the invention will now be explained in detail.

Permanent antistatic agents including quaternary ammonium base-containing copolymers which may be used for the invention include those described in Japanese unexamined Patent Publication No. 4-198308, 6-271780, 6-329923 and 6-179716, and also encompass quaternary ammonium base-containing copolymers, including quaternary ammonium base-containing (meth)acrylate polymers, quaternary ammonium base-containing maleimide copolymers and quaternary ammonium base-containing methacrylamide copolymers.

Quaternary ammonium base-containing polymers useful in the compositions of the present invention may be prepared by standard polymerization techniques. Quaternary ammonium base-containing monomers useful in such polymerizations include N-acrylamido propyl 3-trimethylammonium chloride, N-methacrylamido ethyl 2-trimethylammonium hydrogen sulfate, N-acrylamido butyl 4-ethyldimethylammonium bromide, N-methacrylamido propyl 3-triethylammonium methyl sulfate, N-acrylamido propyl 3-trimethylammonium hydrogen sulfate, and N-acrylamido propyl 3-trimethylammonium ethyl sulfate.

Especially preferred for use as the permanent antistatic agent are permanent antistatic agents comprising a quaternary ammonium base-containing copolymer having 40 to 70% by weight of ethylene residues and 15 to 30% by weight of acrylamide residues, the acrylamide residues having the formula:

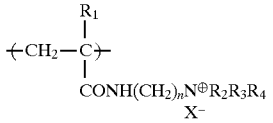

wherein $R_1$ is H or $CH_3$, $R_2$, $R_3$ and $R_4$ are selected from lower alkyl groups having 1 to 4 carbon atoms, X is selected from $HOSO_3$, $CH_3OSO_3$, and $C_2H_5OSO_3$, and n is an integer of 1 to 4. An example of such a permanent antistatic agent is "Rheolex AS-170", Daiichi Kogyo Seiyaku.

The proportion of the permanent antistatic agent containing the quaternary ammonium base-containing copolymer in the magnetic latent image developing toner of the invention is preferably 0.1 to 5 parts by weight. If the proportion of the permanent antistatic agent containing the quaternary ammonium base-containing copolymer in the magnetic latent image developing toner is less than 0.1 part by weight, then the effect of lowering the electrical resistance is reduced, consequently preventing an increase in the transfer voltage, with a reduction in the reflection density upon image output to a recording medium such as, for example, thick paper. If it is greater than 5 parts by weight, the drawback of lower storage stability results etc.

Conductive powders which may be used include carbon black, conductive tin oxide, conductive titanium oxide and conductive magnetic materials etc.

As commercially available products which may be used there may be mentioned the carbon black "Printex L6" by Dequsa etc, the conductive tin oxide "ELCOM TL-30" by Shokubai Kasei Kogyo etc, the conductive titanium oxides "EC-300" by Titanium Kogyo and "FT-1000" by Ishihara Sangyo etc, and the conductive magnetic material "RB-BL" by Titanium Kogyo etc. Especially as for carbon black, there may be further mentioned the carbon black "Printex L" and "Printex XL2" by Dequsa, and "Condretex 975" and "Condretex SC" by Colombia Carbon, and "Kechain Black LC" and "Kechain Black EC600JA" by Lion Co., Ltd. which can be used in a smaller amount than conventional carbon blacks.

The conductive powder is added to the magnetic latent image developing toner of the invention in a proportion of 0.1 to 3 parts by weight, and preferably 0.1 to 1 part by weight, to 100 parts by weight of the toner.

Addition of conductive powder in a proportion of less than 0.1 part by weight reduces the effect of lowering the electrical resistance, and addition at greater than 3 parts by weight impairs the character sharpness. This is also not preferred as it results in poorer fluidity of the toner.

The resin to be used according to the invention may be virtually any of the resins commonly used for electrophotography, including polystyrene resins, styrene/acrylic resins prepared by copolymerizing styrene with any of various esters of acrylic acid or methacrylic acid, or such styrene-based polymers which have been partially crosslinked, as well as polyester resins, epoxy resins, polyamide resins, polyolefin resins and ethylene/vinyl acetate copolymer resins.

These resins may be used either alone or in admixture.

The resins are selected depending on the fixing system, and are used in the range of 20 to 60 parts by weight with respect to the magnetic latent image developing toner.

Magnetic powders which may be used according to the invention include metal compounds such of Ni, Zn, Cu, Co, Fe, Mg, ferrite iron, magnetite, γ-fematite, etc.

The magnetic powder is preferably added to the magnetic latent image developing toner of the invention in a proportion in the range of 50 to 70 parts by weight. A proportion of magnetic powder of less than 50 parts by weight results in weaker magnetism of the toner, reduced carriability of the toner and a tendency toward more fogging, and is therefore not preferred. It is also preferably not greater than 70 parts by weight as this lowers the fixing properties.

Also, since recording proceeds with the magnetic head floating ever so slightly over the surface of the magnetic recording medium, when the frictional electrification of the toner is large, the toner adheres to the magnetic head causing destabilization of the floatation, causing an uneven gap between the magnetic recording medium and the magnetic head, and thus resulting in a poorer image. In order to avoid this problem, the frictional electrification of the magnetic latent image developing toner is preferably between −5 and 5 $\mu$C/g.

One method of controlling this is to employ an external additive and/or charge control agent.

The frictional electrification may be controlled to between −5 and 5 μC/g by adding hydrophobic silica or aluminum oxide, titanium oxide, etc. It will be apparent that a similar effect will be obtained by using more than one of such external additives.

Commercially available products which may be used as external additives include "RA20OH" by Nihon Aerogil K.K., "HDKH2050EP" and "HDKH2015EP" by Wacker Chemicals East Asia K.K., "RFY-C" by Nihon Aerogil K.K., etc. as aluminum oxide and "T-805" by Nihon Aerogil K.K. as titanium oxide.

As for these additives, there can be further mentioned the silica "HDK H2000", "HDK H2000/4", "HDK H3004", and "HDK H3050EP" by Wacker Chemicals, and "R 972D", "R 974D", "R 976D", "R 805", "RX 50", and "RY 200" by Nihon Aerogil, and the titanium oxide "STT-30", and "STT-30A", "STT-30DS", "STT-65ES", "STT-60" and "STT-60T" by Titanium Industries, and "Typer 7 TTO-55(C)", "TTO-55(S)", "TTS-51(C)" and "T-100" by Ishihara Sangyo Co., Ltd.

Control to between −5 and 5 μC/g may thus be achieved by addition of an additive alone.

As for charge control agents, there can be mentioned migrosine, a quaternary ammonium compound, a triphenylmethane dye, a dioxazine, a basic dye and so on.

These typical agents are especially selected from the group consisting of "Bontron N-01", "Bontron N-02", "Bontron-04", "Bontron-05" and "Bontron-51" by Orient Chemicals, "Copy Charge PSY VP2038" and "Copy Blue PR" by Hoedhst, and "TP-415" and "TP-302" by Hodogaya Chemical Co., Ltd.

In addition, control to between −5 and 5 μC/g is possible using a charge control agent (see Japanese Unexamined Patent Publication No. 3-210568).

EXAMPLES

The present invention is explained in more detail below by way of the following examples.

Example 1

| | |
|---|---|
| KBF-IOOS<br>(Iron tetroxide, Kanto Denka Kogyo) | 250 parts by weight |
| FC-051<br>(Polyester resin, Mitsubishi Rayon) | 120 parts by weight |
| FC-344<br>(Polyester resin, Mitsubishi Rayon) | 20 parts by weight |
| Rheolex AS-170<br>(Permanent antistatic agent including quaternary ammonium base-containing copolymer, Daiichi Kogyo Seiyaku) | 3 parts by weight |
| Hiwax NL-500<br>(Polyethylene wax, Mitsui Sekiyli Kagaku) | 10 parts by weight |
| Copy Blue PR<br>(Charge control agent, Hoechst Industries) | 3 parts by weight |

After mixing the above components and melting, kneading and then cooling the mixture to room temperature, it was coarsely and then moderately crushed, and finally finely crushed with a jet mill and sorted to obtain magnetic toner with an average particle size of 9 microns.

| | |
|---|---|
| T-805<br>(titanium oxide, Nihon Aerogil) | 1 part by weight |

-continued

| | |
|---|---|
| Printex L6<br>(conductive carbon black, Degusa) | 0.3 part by weight |

The above components were externally added and mixed with 100 parts by weight of the magnetic toner to obtain magnetic latent image developing toner for Example 3.

The frictional electrification was −2.0 μC/g and the electrical resistance was $2.3\times10^{13}$ Ω·CM.

Comparative Example 1

Magnetic latent image developing toner for Comparative Example 1 was obtained in the same manner as Example 1 except without external addition of Printex L6.

The frictional electrification was −2.8 PC/g and the electrical resistance was $7.8\times10^{13}$ Ω·cm.

Example 2

| | |
|---|---|
| KBF-IOOS<br>(iron tetroxide, Kanto Denka Kogyo) | 250 parts by weight |
| FC-051<br>(Polyester resin, Mitsubishi Rayon) | 120 parts by weight |
| FC-344<br>(Polyester resin, Mitsubishi Rayon) | 20 parts by weight |
| Rheolex AS-170<br>(Permanent antistatic agent including quaternary ammonium base-containing copolymer, Daiichi Kogyo Seiyaku) | 20 parts by weight |
| Hiwax NL-500<br>(Polyethylene wax, Mitsui Sekiyu Kagaku) | 10 parts by weight |
| Copy Blue PR<br>(Charge control agent, Hoechst Industries) | 3 parts by weight |

Magnetic latent image developing toner for Example 2 was obtained in the same manner as Example 1 except for using the components listed above.

The frictional electrification was +1.1 μC/g and the electrical resistance was $5.4\times10^{8}$ Ω·cm.

Comparative Example 2

Magnetic latent image developing toner for Comparative Example 2 was obtained in the same manner as Example 2 except without external addition of Printex L6.

The frictional electrification was +1.9 μC/g and the electrical resistance was $1.7\times10^{9}$ Ω·cm.

Example 3

| | |
|---|---|
| KBF-100S<br>(iron tetroxide, Kanto Denka Kogyo) | 250 parts by weight |
| FC-051<br>(Polyester resin, Mitsubishi Rayon) | 120 parts by weight |
| FC-344<br>(Polyester resin, Mitsubishi Rayon) | 20 parts by weight |
| Rheolex AS-170<br>(Permanent antistatic agent including quaternary ammonium base-containing copolymer, Daiichi Kogyo Seiyaku) | 10 parts by weight |
| Hiwax NL-500<br>(Polyethylene wax, Mitsui Sekiyu Kagaku) | 10 parts by weight |
| Copy Blue PR<br>(Charge control agent, Hoechst Industries) | 3 parts by weight |

Magnetic latent image developing toner for Example 3 was obtained in the same manner as Example 1 except for using the components listed above.

The frictional electrification was −0.8 μC/g and the electrical resistance was $8.3\times10^{11}$ Ω·cm.

Comparative Example 3

| | |
|---|---|
| KBF-100S (iron tetroxide, Kanto Denka Kogyo) | 250 parts by weight |
| FC-051 (Polyester resin, Mitsubishi Rayon) | 120 parts by weight |
| FC-344 (Polyester resin, Mitsubishi Rayon) | 20 parts by weight |
| Rheolex AS-170 (Permanent antistatic agent including quaternary ammonium base-containing copolymer, Daiichi Kogyo Seiyaku) | 0.5 part by weight |
| Hiwax NL-500 (Polyethylene wax, Mitsui Sekiyu Kagaku) | 10 parts by weight |
| Copy Blue PR (Charge control agent, Hoechst Industries) | 3 parts by weight |

After mixing the above components and melting, kneading and then cooling the mixture to room temperature, it was coarsely and then moderately crushed, and finally finely crushed with a jet mill and sorted to obtain magnetic toner with an average particle size of 9 microns.

| | |
|---|---|
| T-805 (titanium oxide, Nihon Aerogil) | 1 part by weight |
| Printex L6 (conductive carbon black, Degusa) | 0.1 part by weight |

The above components were externally added aind mixed with 100 parts by weight of the magnetic toner to obtain magnetic latent image developing toner for Comparative Example 3.

The frictional electrification was −3.5 μC/g and the electrical resistance was $3.6\times10^{14}$ Ω·cm.

| | |
|---|---|
| KBF-IOOS (iron tetroxide, Kanto Denka Kogyo) | 250 parts by weight |
| FC-051 (Polyester resin, Mitsubishi Rayon) | 120 parts by weight |
| FC-344 (Polyester resin, Mitsubishi Rayon) | 20 parts by weight |
| Rheolex AS-170 (Permanent antistatic agent including quaternary ammonium base-containing copolymer, Daiichi Kogyo Seiyaku) | 20 parts by weight |
| Hiwax NL-500 (Polyethylene wax, Mitsui Sekiyu Kagaku) | 10 parts by weight |
| Copy Blue PR (Charge control agent, Hoechst Industries) | 3 parts by weight |

The above components were made into magnetic toner with an average particle size of 9 microns.

| | |
|---|---|
| T-805 (titanium oxide, Nihon Aerogil) | 1 part by weight |
| Printex L6 (conductive carbon black, Degusa) | 5 parts by weight |

The above components were externally added and mixed with 100 parts by weight of the magnetic toner to obtain magnetic latent image developing toner for Comparative Example 4.

The frictional electrification was +0.2 μC/g and the electrical resistance was $7.8\times10^{5}$ Ω·cm.

Comparative Example 5

| | |
|---|---|
| KBF-IOOS (iron tetroxide, Kanto Denka Kogyo) | 250 parts L)y weight |
| FC-051 (Polyester resin, Mitsubishi Rayon) | 120 parts by weight |
| FC-344 (Polyester resin, Mitsubishi Rayon) | 20 parts by weight |
| Rheolex AS-170 (Permanent antistatic agent including quaternary ammonium base-containing copolymer, Daiichi Kogyo Seiyaku) | 35 parts by weight |
| Hiwax NL-500 (Polyethylene wax, Mitsui Sekiyu Kagaku) | 10 parts by weight |
| Copy Blue PR (Charge control agent, Hoechst Industries) | 3 part by weight |

Magnetic latent image developing toner for Comparative Example 5 was obtained in the same manner as Example 1 except for using the components listed above.

The frictional electrification was +2.0 μC/g and the electrical resistance was $1.0\times10^{8}$ Ω·cm.

Comparative Example 6

| Comparative Example 6 | |
|---|---|
| KBF-IOOS (iron tetroxide, Kanto Denka Kogyo) | 250 parts by weight |
| FC-051 (Polyester resin, Mitsubishi Rayon) | 120 parts by weight |
| FC-344 (Polyester resin, Mitsubishi Rayon) | 20 parts by weight |
| Hiwax NL-500 (Polyethylene wax, Mitsui Sekiyu Kagaku) | 10 parts by weight |
| Copy Blue PR (Charge control agent, Hoechst Industries) | 3 parts by weight |

Magnetic latent image developing toner for Comparative Example 6 was obtained in the same manner as Example 1 except for using the components listed above.

The frictional electrification was −2.8 μC/g and the electrical resistance was $9.1\times10^{13}$ Ω·cm.

Comparative Example 7

| Comparative Example 7 | |
|---|---|
| KBF- IOOS (iron tetroxide, Kanto Denka Kogyo) | 250 parts by weight |
| FC-051 (Polyester resin, Mitsubishi Rayon) | 120 parts by weight |
| FC-344 (Polyester resin, Mitsubishi Rayon) | 20 parts by weight |
| Hiwax NL-500 (Polyethylene wax, Mitsui Sekiyu Kagaku) | 10 parts by weight |
| Copy Blue PR (Charge control agent, Hoechst Industries) | 3 parts by weight |

The above components were made into magnetic toner with an average particle size of 9 microns.

| | |
|---|---|
| T-805 (titanium oxide, Nihon Aerogil) | 1 part by weight |
| Printex L6 (conductive carbon black, Degusa) | 2 parts by weight |

The above components were externally added and mixed with 100 parts by weight of the magnetic toner to obtain magnetic latent image developing toner for Comparative Example 7.

The frictional electrification was −2.5 μC/g and the electrical resistance was $7.0\times10^9$ Ω·-cm.

Comparative Eaxmple 8

| Comparative Example 8 | |
|---|---|
| KBF-100S (iron tetroxide, Kanto Denka Kogyo) | 250 parts by weight |
| FC-051 (Polyester resin, Mitsubishi Rayon) | 120 parts by weight |
| FC-344 (Polyester resin, Mitsubishi Rayon) | 20 parts by weight |
| Carbon black Printex L6 (conductive carbon black, Degusa) | 15 parts by weight |
| Hiwax NL-500 (Polyethylene wax, Mitsui Sekiyu Kagaku) | 10 parts by weight |
| Copy Blue PR (Charge control agent, Hoechst Industries) | 3 parts by weight |

Magnetic latent image developing toner for Comparative Example 8 was obtained in the same manner as Example 1 except for using the components listed above.

The frictional electrification was −2.1 μC/g and the electrical resistance was $8.3\times10^9$ Ω·cm.

A model MG-8100 printer of Iwasaki Tsushinki K.K. was then used for image output using each of the magnet latent image developing toners obtained in the above examples and comparative examples. The results are listed in Table 1.

The method of evaluation was as follows.

1) Image density

A Macbeth reflection densitometer RD-918 (product of Sakada Shokai) was used to measure the density of a 1 cm×1 cm pad.

2) Frictional electrification

One hundred parts by weight of surface-oxidized iron powder ([TEFV] of Powdertech Co.) having a particle size in the range of 200–300 mesh and 3 parts by weight of each of the magnetic latent image developing toners were mixed for 10 minutes in a 100 ml glass container and measured with a blow-off electrification measuring apparatus by Toshiba Chemical Co.

3) Head contamination

A model MG-8100 printer by Iwasaki Tsushinki K.K. was used for one copy per recording which was repeated 5000 times, and the adhesion of the toner onto the magnetic head was evaluated.

○: no head contamination, or very little contamination

▽: adhesion of toner onto head

X: adhesion of toner onto head, fading of image during recording

4) Electrical resistance

The magnetic latent image developing toner was molded to a size of 5 cm and a thickness of 5.0 mm under a pressure of 3 ton/cm$^2$, and was subjected to measurement at a voltage of DC 1OV.

5) Character sharpness

○: no scattering of toner around characters, or slight scattering

▽: scattering of toner around characters

X: considerable scattering of toner around characters, making them appear blurred 6) Fixing properties The reflection density of a 1×1 cm printed pad was measured, and then cellophane tape was pasted onto it and a load of 10 kg/cm was applied from above, after which the tape was peeled off at a rate of 1 cm/sec and the reflection density was again measured. The results were calculated by substitution into the expression: (reflection density after peeling cellophane tape)/(reflection density before peeling cellophane tape. ×100 (%).

7) Storability

The toner was passed through a screen after standing for one week in a constant temperature bath at 45° C. and the toner blocking left on the mesh was visually evaluated.

○: no blocking, or slight blocking

▽: blocking of a few mm square

X: blocking of 5 mm square or more

TABLE 1

| | Paper thickness | Reflection density | Character sharpness | Fixation (%) | Head contamination | Storability | Overall evaluation |
|---|---|---|---|---|---|---|---|
| Ex. 1 | 55 kg | 1.38 | ○ | 100.0 | ○ | ○ | ○ |
| | 180 kg | 1.33 | ○ | 97.2 | | | |
| Ex. 2 | 55 kg | 1.42 | ○ | 100.0 | ○ | ○ | ○ |
| | 180 kg | 1.38 | ○ | 98.5 | | | |
| Ex. 3 | 55 kg | 1.42 | ○ | 100.0 | ○ | ○ | ○ |
| | 180 kg | 1.37 | ○ | 98.4 | | | |
| Comp. | 55 kg | 1.30 | ○ | 100.0 | ○ | ○ | x |
| Ex. 1 | 180 kg | 1.14 | ○ | 96.2 | | | |
| Comp. | 55 kg | 1.34 | ○ | 100.0 | ○ | ○ | x |
| Ex. 2 | 180 kg | 1.20 | ○ | 97.6 | | | |
| Comp. | 55 kg | 1.25 | ○ | 100.0 | ○ | ○ | x |
| Ex. 3 | 180 kg | 1.08 | ○ | 96.0 | | | |
| Comp. | 55 kg | 1.50 | x | 100.0 | ○ | ○ | x |
| Ex. 4 | 180 kg | 1.43 | x | 97.9 | | | |
| Comp. | 55 kg | 1.42 | ○ | 100.0 | ○ | x | x |
| Ex. 5 | 180 kg | 1.38 | ○ | 98.0 | | | |
| Comp. | 55 kg | 1.29 | ○ | 100.0 | ○ | ○ | x |
| Ex. 6 | 180 kg | 1.18 | ○ | 95.7 | | | |
| Comp. | 55 kg | 1.35 | ▽ | 100.0 | ○ | ○ | x |
| Ex. 7 | 180 kg | 1.27 | x | 95.2 | | | |
| Comp. | 55 kg | 1.43 | ▽ | 98.2 | ○ | ○ | x |
| Ex. 8 | 180 kg | 1.42 | x | 65.2 | | | |

Note:

Regarding paper thickness, 55 kg is equal to the weight of 1,000 sheets of paper having dimensions of 1,091 m×0.788 m (about 64 g/m$^2$), and 180 kg is equal to weight of 1,000 sheets of paper having dimensions of 1,091 m×0.788 m (about 210 g/m$^2$).

As shown in Table 1, toner containing a permanent antistatic agent which includes a quaternary ammonium base-containing copolymer and having conductive powder externally added thereto provides satisfactory images without variation in the reflection density or character sharpness depending on the type of paper.

The magnetic latent image developing toners obtained in the examples give satisfactory images without increased scattering or fogging of the characters even with repeated copying, and have sufficient fixing properties, as well as good storage stability.

EFFECT OF THE INVENTION

The present invention provides toner which gives satisfactory images with sufficient fixing properties even during high-speed printing, which has good storage stability, and which consistently gives good images without head contamination.

We claim:

1. A magnetic latent image developing toner comprising:

(a) a binding resin;

(b) 50 to 70 parts be weight of a magnetic powder;

(c) 0.1 to 5 parts by weight of a permanent antistatic agent, the permanent antistatic agent comprising a quaternary ammonium base-containing copolymer having 40 to 70% by weight of ethylene residues and 15 to 30% by weight of acrylamide residues, the acrylamide residues having the formula:

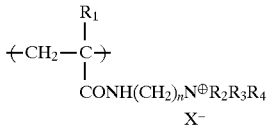

wherein $R_1$ is H or $CH_3$, $R_2$, $R_3$ and $R_4$ are selected from lower alkyl groups having 1 to 4 carbon atoms, X is selected from $HOSO_3$, $CH_3OSO_3$, and $C_2H_5OSO_3$, and n is an integer of 1 to 4; and (d) 0.1 to 3 parts by weight of a conductive powder, the toner having both an electrical resistance of $10^8$–$10^{14}$ Ω·cm and a frictional electrification of −5 to 5 μC/g by an external additive or charge control agent.

2. Magnetic latent image developing toner according to claim 1, wherein the conductive powder is selected from carbon black, conductive tin oxide, conductive titanium oxide, and conductive magnetic materials.

3. Magnetic latent image developing toner according to claim 1, wherein the conductive powder is selected from carbon black, conductive tin oxide, conductive titanium oxide, and conductive magnetic materials.

* * * * *